US010047694B2

(12) United States Patent
Laqua et al.

(10) Patent No.: US 10,047,694 B2
(45) Date of Patent: Aug. 14, 2018

(54) SLIDE SHOE FOR A PISTON FOR USE IN INTERNAL COMBUSTION ENGINES

(71) Applicant: KS KOLBENSCHMIDT, GMBH, Neckarsulm (DE)

(72) Inventors: Matthias Laqua, Neckarsulm (DE); Markus Pinz, Neckargerach (DE)

(73) Assignee: KS KOLBENSCHMIDT GMBH, Neckarsulm (DE)

( * ) Notice: Subject to any disclaimer, the term of this patent is extended or adjusted under 35 U.S.C. 154(b) by 0 days.

(21) Appl. No.: 14/898,395

(22) PCT Filed: Jun. 13, 2014

(86) PCT No.: PCT/EP2014/062370
§ 371 (c)(1),
(2) Date: Dec. 14, 2015

(87) PCT Pub. No.: WO2014/198891
PCT Pub. Date: Dec. 18, 2014

(65) Prior Publication Data

US 2016/0146151 A1 May 26, 2016

(30) Foreign Application Priority Data

Jun. 14, 2013 (DE) ..... 10 2013 211 215

(51) Int. Cl.
*F02F 3/28* (2006.01)
*F02F 3/22* (2006.01)
*F02F 3/00* (2006.01)

(52) U.S. Cl.
CPC ..... *F02F 3/22* (2013.01); *F02F 3/0015* (2013.01); *F02F 3/28* (2013.01); *F02F 3/285* (2013.01)

(58) Field of Classification Search
CPC ..... F02F 3/0015; F02F 3/285
USPC ..... 123/41.35, 193.6
See application file for complete search history.

(56) References Cited

U.S. PATENT DOCUMENTS 2,442,408 A 6/1948 Bradley
6,829,977 B2 * 12/2004 Messmer ..... F02F 3/22 92/1

FOREIGN PATENT DOCUMENTS

DE 4018252 A1 12/1991
DE 10022035 A1 11/2001
FR 2371581 A1 6/1978
GB 2033525 A 5/1980

* cited by examiner

*Primary Examiner* — Jacob Amick
*Assistant Examiner* — Charles Brauch
(74) *Attorney, Agent, or Firm* — Young Basile Hanlon & MacFarlane, P.C.

(57) ABSTRACT

A piston for an internal combustion engine has a sliding shoe carried in a force accumulator. The sliding shoe has a channel to transfer cooling oil into a hollow space. The force accumulator is located is a channel formed by the piston, and the sliding shoe is guided partially inside the force accumulator.

7 Claims, 3 Drawing Sheets

SLIDE SHOE FOR A PISTON FOR USE IN INTERNAL COMBUSTION ENGINES

BACKGROUND

The disclosure relates to a piston for an internal combustion engine, wherein the piston has a sliding shoe mounted in a force accumulator and wherein the sliding shoe has a channel to transfer cooling oil into a hollow space.

DE 100 22 035 A1 discloses a combustion engine with a built-up piston consisting of a steel piston crown and a piston lower part which are joined by means of a single bolt located in the center axis, or close to the center axis, of the piston and having a central cooling space between the piston crown and the piston lower part and an oil-conducting connecting rod that is connected by a wrist pin to the piston lower part.

Only a small gap exists between the piston and the connecting rod. Using the present-day solution of the geometry of the sliding shoe, it is not possible to guide the sliding shoe in the piston. The function of the sliding shoe is to introduce the cooling oil that rises through the connecting rod into the piston. In this, the sliding shoe is designed such that the connecting rod sits directly on the sliding shoe and follows, or imitates, the pivoting motion of the connecting rod. The prior art looks as follows: the spring (force accumulator) sits inside the guide. Consequently, the diameter and thus the pre-load are small; in order to increase the pre-load, specific spring properties must be present.

It is desirable to achieve a reduction in the installation space between the connecting rod and the piston.

SUMMARY

In accordance with one aspect, provision is made for the force accumulator to be located in a channel formed by the piston and for the sliding shoe to be guided partially within the force accumulator.

This arrangement advantageously reduces the installation space while simultaneously increasing the vertical length of the guide. When defining the problem using the prior art as a basis, insufficient installation space was available, so spring windings had to be shortened and the necessary pre-load force had to be generated at the same time. This was achieved by increasing the spring diameter. The guide for the sliding shoe now sits internally and the spring externally. A further advantage of this construction is that while reducing the installation space the vertical length of the sliding shoe guide is nevertheless simultaneously increased.

Further provision is made for the channel to be circumferential around the sliding shoe. This construction makes it possible for the sliding shoe to be guided evenly. In addition, the force accumulator exerts a uniform force on the sliding shoe.

Further provision is made for the channel next to the force accumulator to accommodate a guide element. The guide element acts as an application point for the force accumulator and stabilizes the sliding shoe in the channel.

Further provision is made for a sleeve to limit the travel of the sliding shoe. The sliding shoe is given a defined end stop as a result of the travel limited by the sleeve.

Further provision is made for a retaining ring to prevent the loss of the sliding shoe in the event of the piston and the connecting rod small end separate. The retaining ring not only prevents the loss of the sliding shoes, but advantageously forms an additional stop in the travel of the sliding shoe as an alternative or as a supplement to the safety function.

Further provision is made for the piston to be equipped with a sliding shoe for use in internal combustion engines, having a piston lower part and a piston upper part, wherein the sliding shoe has a channel to transfer cooling oil from a connecting rod small end into a hollow space, and wherein a force accumulator is guided in a channel. This permits a compact construction for the piston because the force accumulator is guided in the channel in order to save space.

BRIEF DESCRIPTION OF THE DRAWINGS

The sliding shoe for a piston is further clarified using the Figures described in which.

DETAILED DESCRIPTION

In the following description of the Figures, terms such as top, bottom, left, right, front, rear, etc. refer solely to the representation and position of the device and other elements selected as an example in the respective Figures. These terms are not to be understood in a restrictive sense, that is to say these references can change as the result of different positions and/or mirror-image layout or similar.

Figure 1:
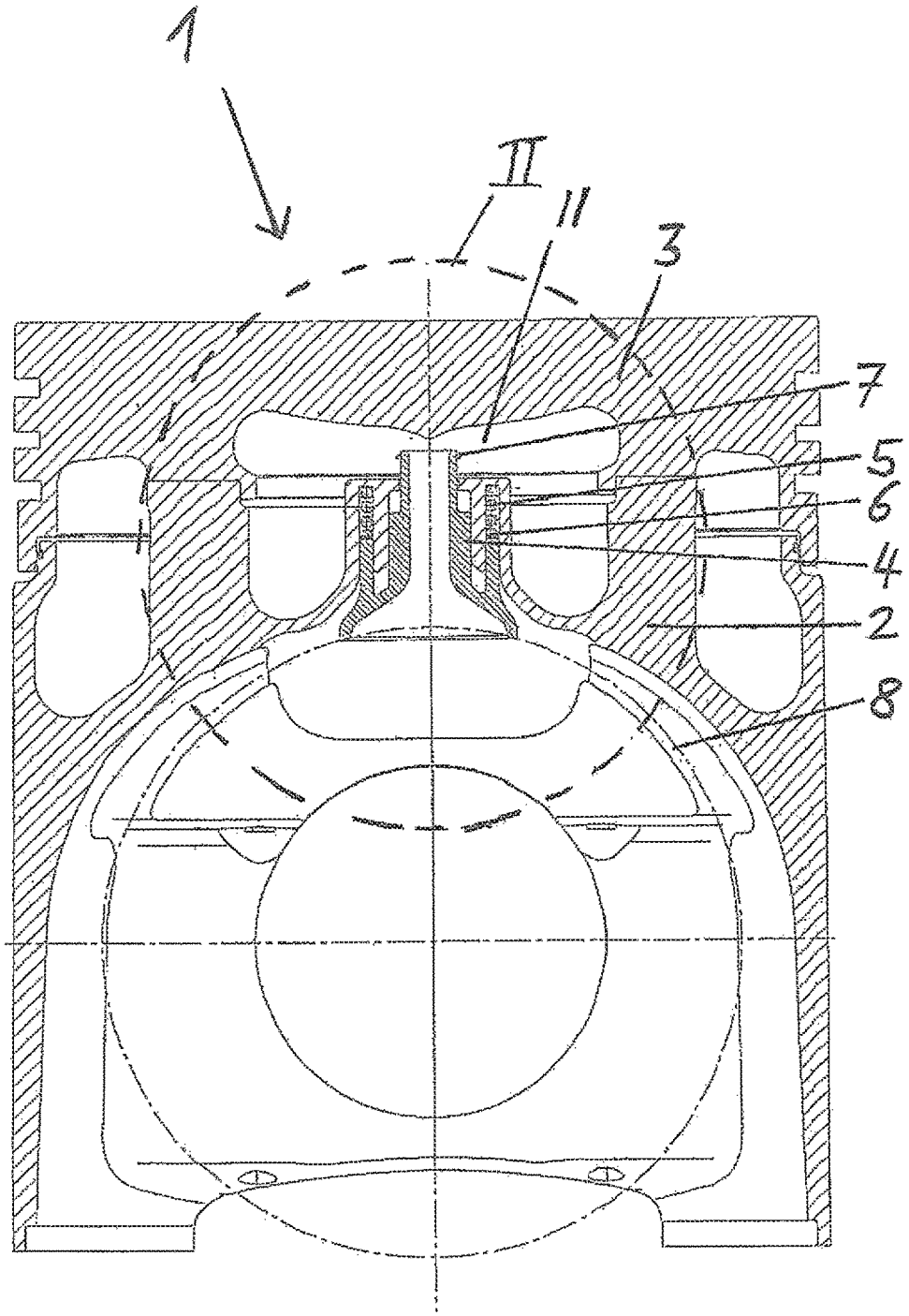
FIG. 1 shows a cross sectional view of a piston in accordance with the invention.

FIG. 1 shows a piston 1 that is made up of a piston lower part 2 and a piston upper part 3. The piston 1 possesses a sliding shoe 4. The sliding shoe 4 is pre-loaded by means of a force accumulator 5, designed as a compression spring, and further specifically as a coil spring. The pre-loading is effected against a connecting rod small end 8 in the case of a piston-connecting rod system. A disc 6, which transfers the forces from the force accumulator 5 to the sliding shoe 4, may be, but does not have to be, located between the force accumulator 5 and the sliding shoe 4. An optional retaining ring 7 is provided to prevent the sliding shoe 4 from falling out of the guide in the piston 1. The sliding shoe 4 with sliding elements 9 rests on the outer circumference of a connecting rod small end 8. The sliding shoe 4 has a central channel 10 to conduct a medium, for example, cooling oil, into a hollow space 11 of the piston 1. The channel 10 expands in a funnel shape towards the bottom (when viewing the Figures) in the direction of the connecting rod small end 8. As a result of the funnel-shaped construction, the medium can more easily reach the channel 10 from the connecting rod small end 8. The connecting rod small end 8 is supplied with the medium through a passageway in the connecting rod. The hollow space 10 is preferably located below the combustion chamber of the piston 1.

Figure 2:
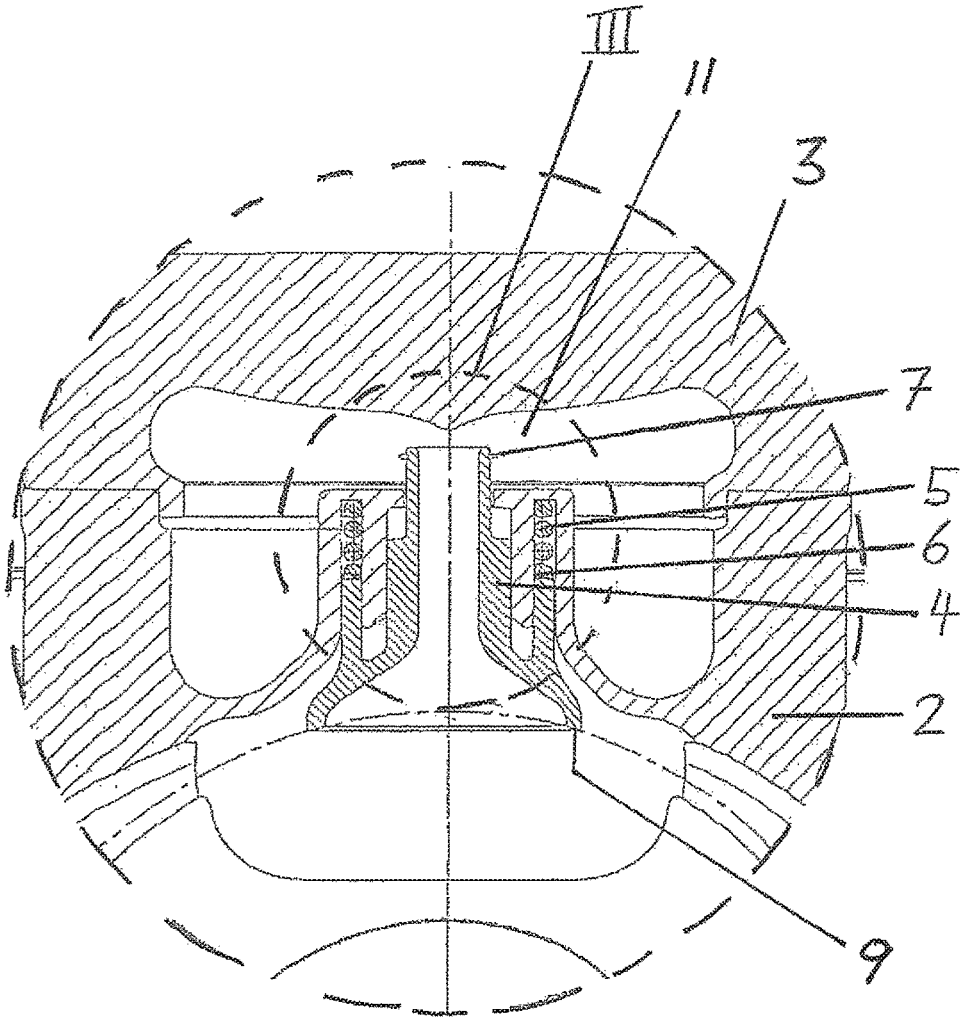
FIG. 2 is an enlarged view of the area of the sliding shoe as detail II from FIG. 1.

FIG. 2 is a detail view of the area of the sliding shoe 4.

Figure 3:
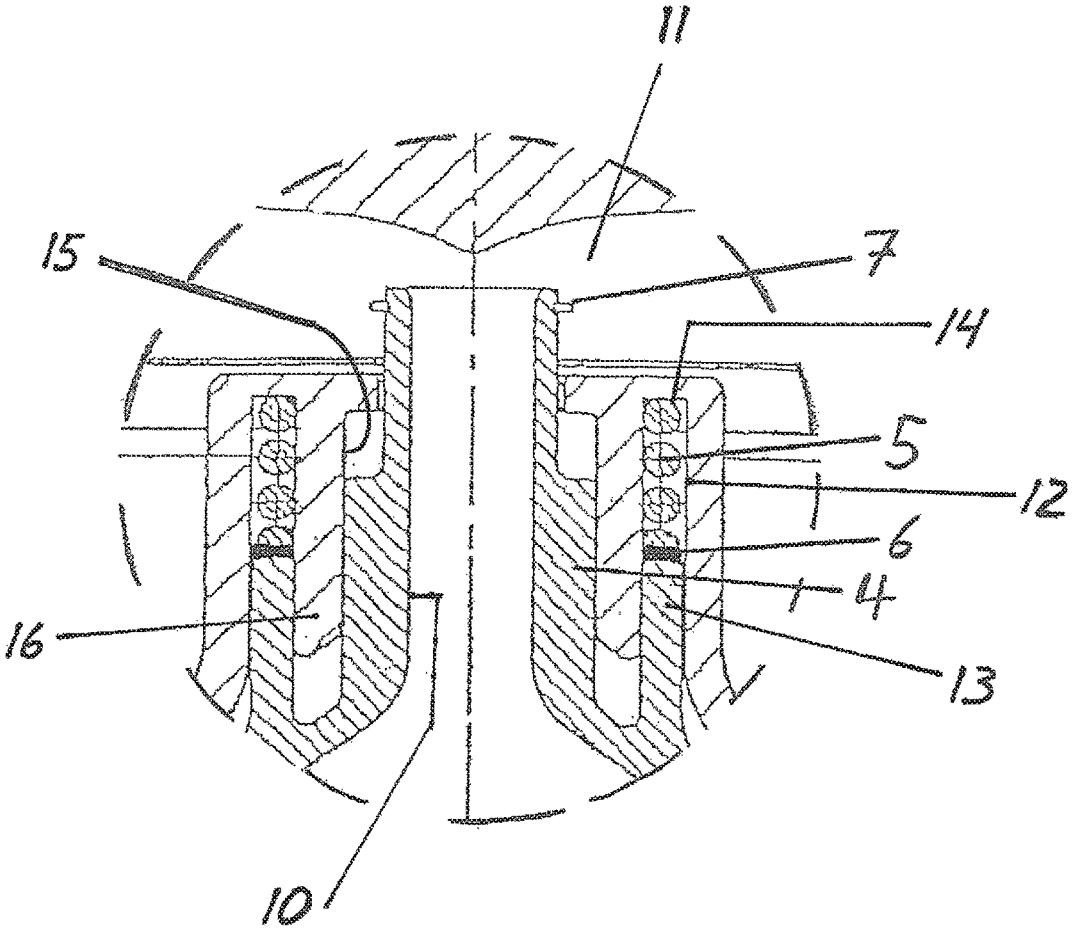
FIG. 3 is an enlarged view of the guide for the sliding shoe as detail III from FIG. 2.

FIG. 3 is a detail view of the guide for the sliding shoe 4. The guide for the sliding shoe 4 is provided by a radially circumferential channel 12. A radially circumferential guide element for the sliding shoe 4 is carried moveably in this channel 12. The channel 12 accommodates the force accumulator 5 and the disc 6. The disc 6 is supported on the guide element 13, and force from the force accumulator 5 drives the disc 6 towards the connecting rod small end 8. The force accumulator 5 is supported at an opposite end on the closed end area 14 of the channel 12. The sliding shoe 4 can additionally be, but does not have to be, guided in a central sleeve 15. This central sleeve is formed integrally with the piston lower part 2. The wall 16 of the central sleeve 15 simultaneously forms the boundary of the channel 12. The result of guiding the sliding shoe 4 and the central sleeve 15 in parallel in the channel 12 is a solid mount for the sliding shoe 4 in the piston 1.

What is claimed:

1. A piston for use in an internal combustion engine comprising:

a piston upper part defining a hollow space;

a piston lower part connected to the piston upper part, the piston lower part having a first wall and a second wall defining an elongate force accumulator channel radially spaced from a piston longitudinal axis, the piston lower part first wall further defining a central sleeve channel, the force accumulator channel is spaced radially outward from the central sleeve channel and radially separated by the piston lower part first wall;

a force accumulator positioned in the force accumulator channel; and a sliding shoe comprising:

a body having a first upwardly extending guide element axially and slidingly positioned in the central sleeve channel, the body and first upwardly extending guide element defining a sliding shoe central channel operative to allow passage of a medium through the sliding shoe to the piston upper hollow space; and a second upwardly extending guide element connected to the body positioned radially outward from the first upwardly extending guide element, the second upwardly extending guide element positioned in the force accumulator channel in biasing engagement with the force accumulator, the force accumulator operative to bias the sliding shoe away from the piston upper part.

2. The piston of claim 1 wherein the body is slidingly engaged with central sleeve channel.

3. The piston of claim 1 further comprising a disc positioned between the force accumulator and the second upwardly extending guide element.

4. The piston of claim 1 wherein the force accumulator channel is circumferentially positioned and radially outwardly spaced about the central sleeve channel.

5. The piston of claim 1 wherein the medium is cooling oil.

6. The piston of claim 1 wherein the sliding shoe body further comprises a retaining ring radially extending from the body first upwardly extending guide element, the retaining ring operable to prevent axial disengagement of the body from the central sleeve channel.

7. The piston of claim 1 wherein the force accumulator comprises a compression coil spring.

* * * * *